US005759429A

United States Patent [19]

Trimmer et al.

[11] Patent Number: 5,759,429

[45] Date of Patent: Jun. 2, 1998

[54] APPARATUS FOR INTERCONNECTING CONCRETE FORMS

[75] Inventors: Douglas E. Trimmer, Kansas City; Dwight E. Hibbs, Grandview; James Otto Mittelstadt, Independence, all of Mo.

[73] Assignee: Precise Forms, Inc., Kansas City, Mo.

[21] Appl. No.: 618,312

[22] Filed: Mar. 19, 1996

[51] Int. Cl.[6] ..... E04G 9/00

[52] U.S. Cl. ..... 249/196; 249/47

[58] Field of Search ..... 249/47, 196; 29/525.01, 29/525.03, 897.32

[56] References Cited

U.S. PATENT DOCUMENTS

| | | | |
|---|---|---|---|
| 3,204,918 | 9/1965 | Bonin et al. | 249/191 |
| 3,765,465 | 10/1973 | Gulistan | 151/69 |
| 3,877,674 | 4/1975 | Cerutti | 249/196 |
| 4,194,717 | 3/1980 | Easton et al. | 249/192 |
| 4,285,380 | 8/1981 | Gulistan | 411/103 |
| 4,963,063 | 10/1990 | Gulistan | 411/105 |
| 4,975,009 | 12/1990 | Easton et al. | 411/354 |
| 5,082,406 | 1/1992 | Cosenza | 411/105 |
| 5,083,740 | 1/1992 | Sawyer et al. | 249/219.1 |
| 5,174,909 | 12/1992 | Ward | 249/44 |
| 5,251,868 | 10/1993 | Trimmer et al. | 249/196 |

FOREIGN PATENT DOCUMENTS

| | | |
|---|---|---|
| 2515716 | 5/1983 | France . |
| 2531463 | 2/1977 | Germany . |
| 2747064 | 5/1979 | Germany . |

*Primary Examiner*—David W. Wu

*Attorney, Agent, or Firm*—Hovey, Williams, Timmons & Collins

[57] ABSTRACT

An assembly (20) for releasably interconnecting a pair of concrete form panels (28, 28*a*) having adjacent, apertured walls (30, 30*a*) is provided which completely eliminates loose parts and significantly reduces panel setup and knock-down times. The assembly (20) includes an elongated pin (22) axially shiftable between extended and retracted positions, as well as an elongated connection arm (24) of length to bridge the walls (30, 30*a*) and engage a surface (44*a*) of one wall (30*a*). An operating mechanism (70) is operatively coupled with pin (22) and arm (24) and serves to draw the walls (30, 30*a*) together when pin (22) is extended through the wall apertures (32, 32*a*). A latch assembly (96) serves to releasably maintain the pin (22) and arm (24) in their respective positions.

9 Claims, 3 Drawing Sheets

APPARATUS FOR INTERCONNECTING CONCRETE FORMS

BACKGROUND OF THE INVENTION

1. Field of the Invention

The present invention is broadly concerned with an improved connector pin assembly of the type used for releasably interconnecting a pair of adjacent apertured concrete form panels. More particularly, it is concerned with such a pin assembly and a method of use thereof, wherein the entire assembly is connected to a form panel and is used without any extraneous loose parts such as wedges or the like; the assembly hereof can also be used to draw together and securely interconnect panels which are significantly spaced apart and slightly misaligned, thereby reducing form setup time and labor costs.

2. Description of the Prior Art

Many present day poured concrete structures are constructed using prefabricated, reusable, interlocking form sections or panels. These panels are necessarily of relatively high strength, yet preferably are compact and lightweight. Thus, concrete form panels are advantageously constructed from aluminum, and are designed to be interconnected end-to-end as well as in opposed relationship, to present a wall form for example. For purposes of end-to-end interconnection, the panels generally include vertically extending end walls having a series of spaced openings therethrough. When placed in juxtaposition with the end wall apertures in alignment, the individual panels are typically interconnected by means of slotted pin and wedge assemblies. Thus, slotted pins are driven through aligned end wall apertures, and a wedge is then placed within the pin slot in order to lock the individual panels together. When the form is disassembled, the wedges are loosened and removed, and the pins extracted from the form panel apertures.

Use of traditional detached panel connection hardware presents a number of problems. First and foremost, many of the hardened pins and wedges are lost during the normal process of form construction and disassembly, simply because they are not permanently attached to a form panel. Moreover, use of this detached hardware can be labor-intensive, inasmuch as the panels must be held in alignment, while the connection hardware is first properly positioned and then driven into place.

In response to these problems, attempts have been made at developing pin assemblies which are permanently secured to the form panels. For example, U.S. Pat. No. 4,194,717 describes such an assembly wherein a pin or bolt is shiftably mounted adjacent the end wall of a form panel, and is adapted for passage through aligned end wall apertures for connection purposes. In addition, the pin includes a groove adjacent the rearward end thereof which is adapted to receive a locking wedge when the pin is in its retracted position, thereby maintaining the pin in this position and allowing wedge storage.

Another attached hardware system makes use of a tapered pin having a rearward extension received within a slide block, the latter carrying a synthetic resin disk designed to maintain the position of the locking pin relative to the panel end wall aperture. Here again, each pin is driven forwardly and passes through aligned panel apertures, and a tapered wedge is used to complete the panel interconnection.

One drawback of these prior designs stems from the fact that they are not readily retrofittable, requiring welded-on attachments to the individual form panels. Furthermore, they relatively heavy, which is significant when it is considered that a large number of forms are typically transported to a construction site. Finally, these designs suffer from the fact that, owing to normal pin wear, the pins can become significantly misaligned or subject to "wobble." This is objectionable not only because the installer must manually align the pins before panel connection can be completed, but also because such misaligned pins may prevent or interfere with stacking and handling of detached panels.

In response to these problems, a greatly improved connector pin assembly described in Pat. No. 5,251,868 was developed. This patented structure makes use of an axially tapered, slotted pin together with a resilient metallic retaining ring coupling the pin to a form panel. In this fashion, the pin is permanently secured to the form and can be readily driven through aligned form wall apertures. The interconnection is complete through the use of a wedge driven into the pin slot. While the assembly described in the '868 patent represents a significance advancement in the art, it does not entirely eliminate extraneous loose parts, i.e., the wedge forming a part of the assembly is not connected to a form and is thus subject to loss.

All known prior interconnecting assemblies also require that the forms to be interconnected be in very close proximity to each other (e.g., normally within about ¼–½ of an inch); otherwise, when the pin is driven through the apertures, there is insufficient open slot in the pin to accept a wedge. Thus, use of prior interconnecting assemblies is relatively labor-intensive, because of the need to very closely position and align the forms prior to the actual interconnection thereof.

There is accordingly a need in the art for an improved form panel connection assembly which entirely eliminates loose parts and moreover allows interconnection of relatively widely spaced or even slightly misaligned panels.

SUMMARY OF THE INVENTION

The present invention overcomes the problems outlined above, and provides an assembly for releasably interconnecting a pair of panels cooperatively presenting first and second adjacent walls having respective, generally aligned apertures therethrough. Broadly speaking, the interconnecting assembly includes an elongated pin presenting a forward end and a rearward end and axially shiftable between a retracted position wherein the forward end of the pin is proximal to the aperture through a first panel wall, and an extended connecting position where the pin is oriented for extending through the apertures of both the first and second walls. The overall assembly further includes an elongated connection arm having a forward end and a rearward end and of a length sufficient to bridge the first and second walls; the arm is selectively movable between a retracted, non-bridging position, and an extended position where the arm bridges the walls and the forward end thereof engages a face of one of the walls. An operating mechanism is coupled with the pin and arm for causing the arm to draw the first and second walls together and place them in compression when the arm is positioned in its bridging orientation.

In preferred forms, the assembly includes spring-loaded latch means for releasably maintaining the pin and arm in the extended panel-connecting positions thereof; the latch is also advantageously designed to retain the pin and arm in their respective retracted and non-bridging positions.

The operating mechanism is preferably in the form of a handle pivotally coupled to the rearward end of the pin, together with means pivotally connecting the rearward end of the arm to the handle. The pin is selectively movable to its fully extended position where a form tie may be placed over the pin; next a second panel is moved so that the pin projects slightly through the appropriate wall opening thereof and the connection arm is placed in its bridging relationship across the adjacent walls. The handle is then movable in a direction so as to draw the first and second walls together and to lock the operating mechanism in place to maintain the connection between the panels. In particularly preferred embodiments, means is provided for captively retaining the pin on one of the panels and permitting axial shifting thereof, while the handle is pivotally coupled to the rearmost end of the pin. The arm is in turn pivoted to the handle, and the spring-loaded latch mechanism is permanently mounted to the one panel. Hence, the entire interconnecting assembly is secured to the panel with the complete elimination of loose parts. The assembly may thus be retrofitted onto existing panels.

DETAILED DESCRIPTION OF THE PREFERRED EMBODIMENT

Figure 1:
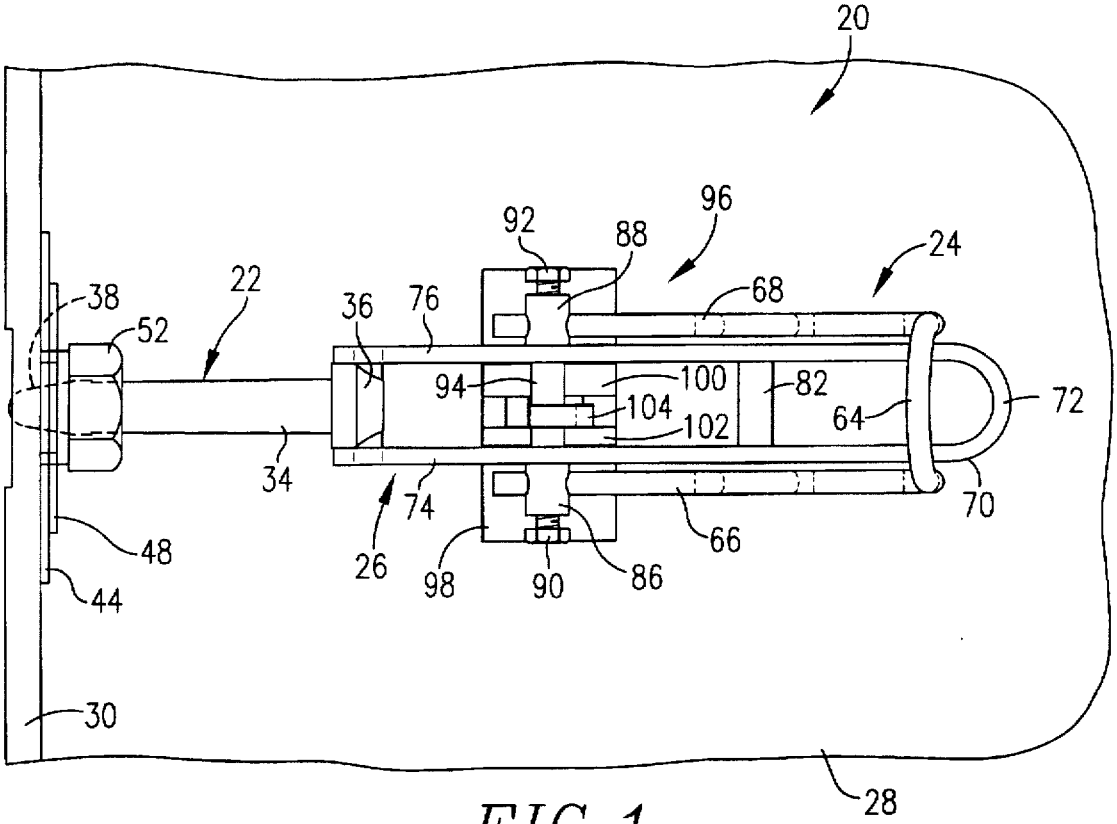
FIG. 1 is a elevational view of a form panel having the panel interconnecting assembly of the invention mounted thereon, with the interconnecting assembly in its retracted position.
Figure 2:
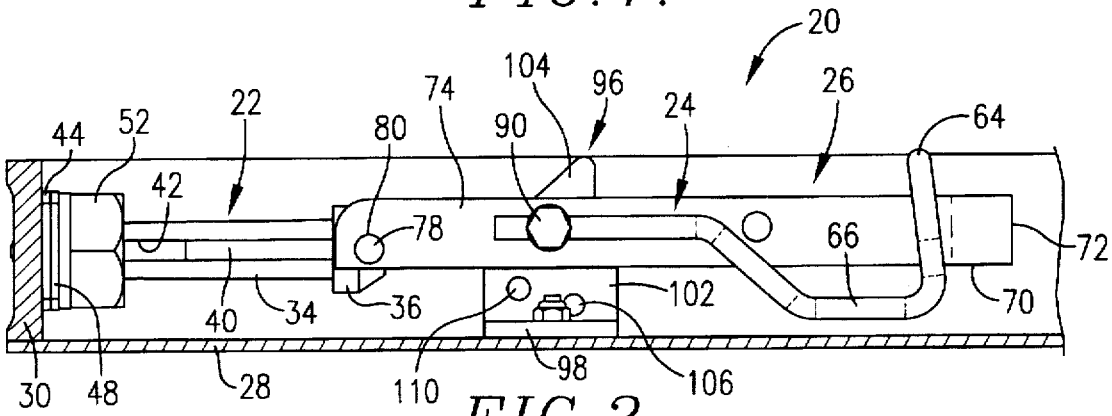
FIG. 2 is a side view partially in section and further illustrating the interconnecting assembly in its retracted position.
Figure 3:
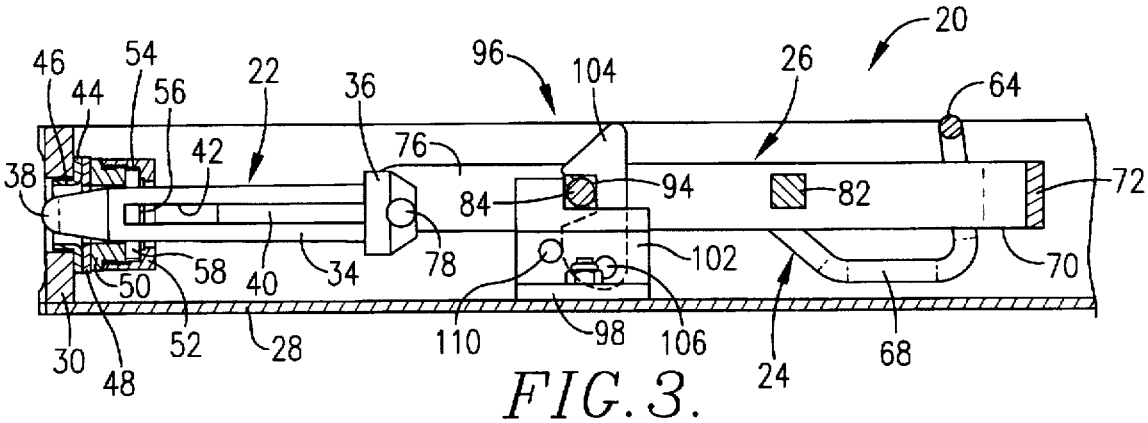
FIG. 3 is a sectional view of the interconnecting assembly in its retracted position, showing the details of construction thereof.

Turning now to the drawings, and particularly FIGS. 1–3, a panel interconnecting assembly 20 is illustrated. Broadly speaking, the assembly 20 includes an elongated pin 22, an elongated connection arm 24, and operating mechanism 26 operatively coupled with the pin and arm. As shown, the assembly 20 is mounted to an aluminum concrete form panel 28 having a transverse end wall 30 provided with a pin-receiving apertures 32 therethrough. It will of course be understood that a separate assembly 20 is provided for each of a series of apertures in a given panel 28.

In more detail, the pin 22 is formed of hardened steel and has an elongated and slightly axially tapered shank 34, and presents a rearmost enlarged head 36 and a tapered forward end 38. It will be observed that the shank is provided with a pair of elongated, opposed slots 40 extending substantially the full length thereof. A bore 42 extends between and communicates with the slots 40 adjacent the forward end 38 of shank 34.

Figure 10:
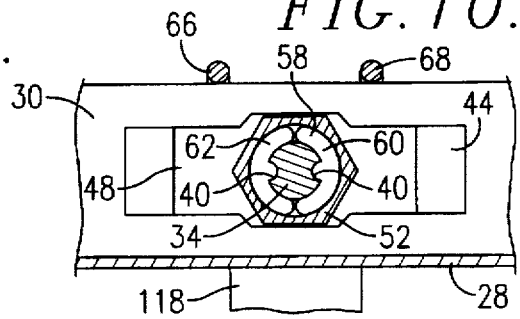
FIG. 10 is a sectional view taken along line 10—10 of FIG. 7.

A first plate 44 is secured to end wall 30 adjacent each aperture 32 therein. The plate 44 has an outwardly extending boss 46 (see FIG. 3) extending into the corresponding aperture 32 as a reinforcement. A second apertured plate 48 is also secured to first plate 44. The second plate 48 has rearwardly extending, externally threaded connection boss 50 in registry with boss 46 and secured to the face of second plate 48 remote from the latter. A threaded annular end cap 52 is threaded onto boss 50 leaving a substantial open area 54 between the rearmost face of boss 50 and the adjacent inner face of cap 52. A pair of operating components are disposed within area 54, namely a resilient metallic retaining ring 56 and a two-piece split tab washer 58 (see FIG. 10). The ring 56 is formed of heat treated, stainless steel and is designed to compressively and frictionally engage shank 34 with considerable force. The washer 58 is likewise formed of heat treated, stainless steel and presents a pair of mirror image sections 60, 62 of semi-circular configuration having corresponding inwardly extending tabs received and slidable in the shank slots 40. The resilient ring 56 and washer 58 can thus float within area 54 during extension and retraction of pin 22. Further details concerning the preferred construction of the pin and mounting assembly can be found in U.S. Pat. No. 5,251,868 which is incorporated by reference herein.

Arm 24 is formed of heavy wire and presents a forwardmost, generally U-shaped bight segment 64 and a pair of dog leg arm sections 66, 68 extending from the segment 64. As explained in detail hereinafter, the arm 24 is of sufficient length to bridge a pair of panels 28, 28*a* to be interconnected with bight segment 64 engaging the remote face of wall 30 of panel 28*a*.

Operating mechanism 26 is in the form of an elongated, U-shaped handle 70 having a rearmost bight 72 and a pair of straight legs 74, 76. The ends of the legs 74, 76 are pivotally connected to pin head 36 by means of an outwardly extending pivot pin 78 received within a corresponding pin aperture 80 formed in each leg 74, 76. The handle 70 supports a transversely extending latch block 82 between legs 74, 76. In addition, the ends of arm sections 66, 68 are pivotally coupled to handle 70 between block 82 and bolt head 36. Specifically, a transverse pivot pin 84 extends through appropriately configured apertures in legs 74, 76. The pin 84 supports outboard annular segments 86, 88 which are apertured and receive the ends of the arm sections 66, 68 as shown. Respective set screws 90, 92 are employed for securing the arm sections within the corresponding outboard segments 86, 88. Pin 84 also supports a substantially square in cross-section segment 94 between the handle legs 74, 76. The segment 94 is fixed to the pin 84 by means of set screws (not shown).

Figure 9:
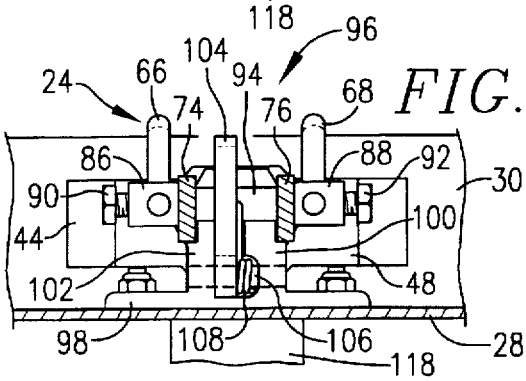
FIG. 9 is a sectional view taken along line 9—9 of FIG. 6.

The overall operating mechanism also includes a spring-loaded latch assembly 96 permanently affixed to panel 28 by bolts or other suitable means. The latch assembly 96 includes a metallic base plate 98 with a pair of integral, upstanding, apertured ears 100, 102. An upstanding, generally hook-shaped latch 104 is pivotally supported between the ears 100, 102 by means of transverse pin 106. A torsion spring 108 (see FIG. 9) is disposed about pin 106 and serves to bias latch 104 in a leftward or counterclockwise direction as viewed in FIGS. 1–3. A transverse, stationary stop bar 110 is also supported and extends between ears 100, 102 and serves to limit the leftward pivoting motion of the latch 104.

Figure 4:
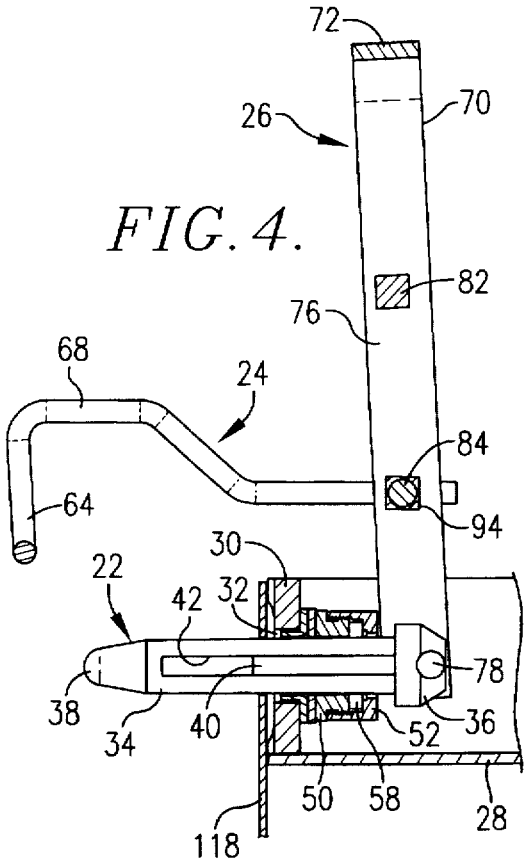
FIG. 4 is a sectional view illustrating the operation of the interconnecting assembly of the invention, and depicting the pin in its extended position with a form tie mounted on the pin, and with the connection arm disposed above the pin.

The use of interconnecting assembly 20 is best illustrated through a consideration of FIGS. 4–7. In this connection, such use is illustrated with reference to interconnecting panel 28 to a second panel 28*a*. The respective panels each have a transverse end wall 30, 30*a*, with corresponding wall apertures 32, 32*a*. End wall 30*a* presents an inner face 112 and an outer face 114. The inner face 112 is equipped with an apertured reinforcing plate 44*a* as is conventional in the art. During the course of interconnecting the panels 28, 28*a*, it is conventional to insert between the end walls 30, 30*a* an apertured form tie 118 which extends across the form for similar interconnection between a pair of opposed form panels. To this end, the adjacent outer faces of the walls 30, 30*a* are recessed as best seen in FIG. 4 so as to accommodate form tie 118 while still maintaining a secure, tight connection between the panels 28, 28*a*.

During initial use, the assembly 20 would be in its retracted and locked position illustrated in FIGS. 1–3. Specifically, the shank 34 of pin 22 is retracted, and the latch 104 engages segment 94 carried by pin 84. This locks the handle 70 in place, and also retains arm 24 in its retracted position disposed about handle 70 with bight 64 extending above and over the extreme end of the handle.

When it is desired to interconnect the panels 28, 28*a* (see FIG. 4), the pin 22 is first moved to its extended position and arm 24 is located above the panel 28*a* as shown. In this orientation, the handle 70 is substantially upright. A form tie 118 is then slipped onto the pin 22 as also illustrated in FIG. 4.

Figure 4A:
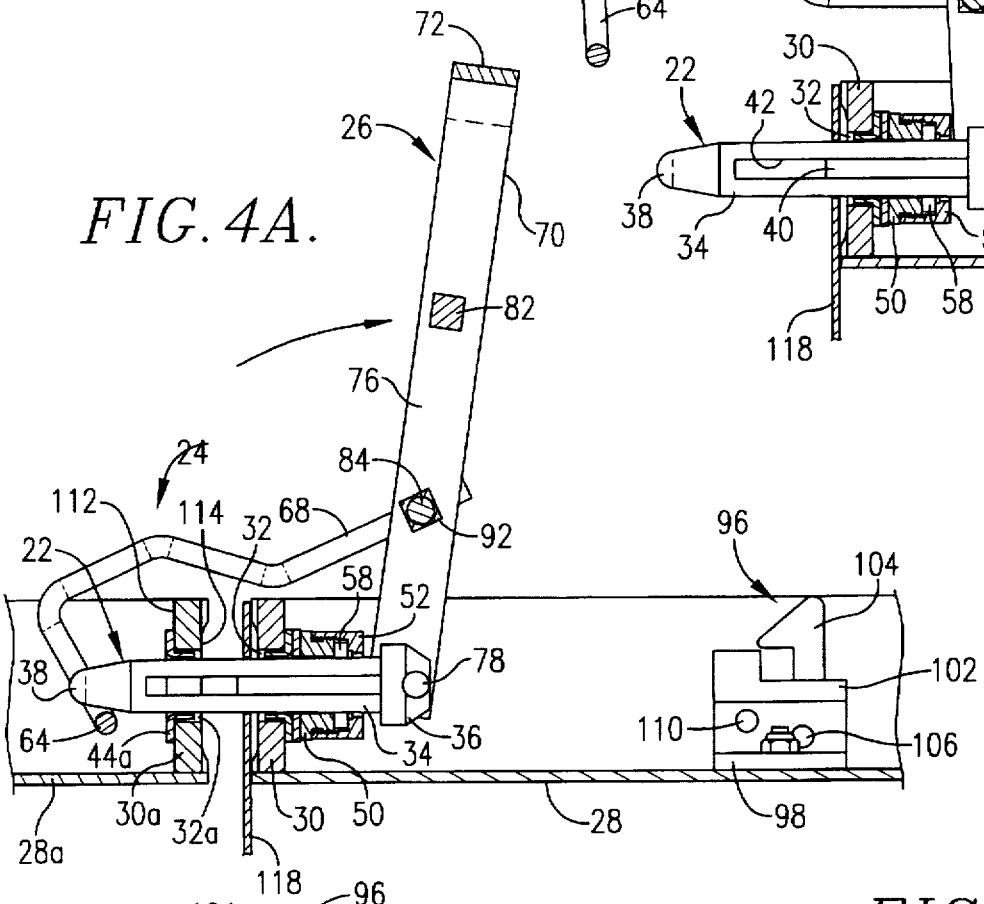
FIG. 4A is a view similar to that of FIG. 4, but illustrating the next step in the connection procedure wherein the forward end of the pin is inserted through the opening of an adjacent panel, the connection arm is moved downwardly over the pin to engage the remote face of the second panel wall, and the handle is pivoted in a direction in order to draw the panels together.

The panel 28*a* is next brought into proximity with panel 28, i.e., the wall 30*a* is placed close to wall 30 with the end 38 of pin 22 extending through aperture 32*a* of wall 30*a* (see FIG. 4A). The arm 24 is then pivoted downwardly to a position wherein bight 64 passes beneath pin 22 and engages plate 44*a*. The handle 70 is then grasped and pivoted in a clockwise direction, which has the effect of pulling the arm 24 rightwardly as viewed in FIG. 4A in order to compressively draw end walls 30, 30*a* together. This pivoting motion of the handle 70 is continued until the handle assumes an orientation substantially parallel with panel 28. During the final stage of this movement, the latch block 82 engages the oblique upper face of latch 104, causing the latch to pivot rightwardly or clockwise as viewed in FIG. 4 until the block 82 clears the latch upper face. At this point, the spring 108 biases the latch leftwardly or counterclockwise as viewed in FIG. 4 in order to fully engage and latch the block 82 (see FIG. 7).

Figure 8:
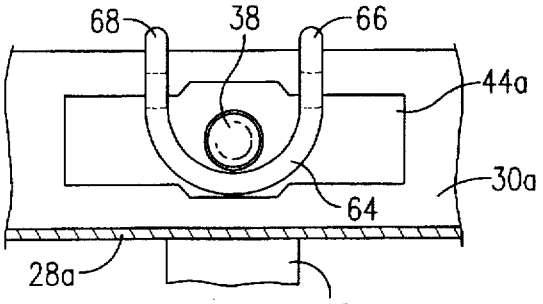
FIG. 8 is a sectional view taken along line 8—8 of FIG. 6.
Figure 5:
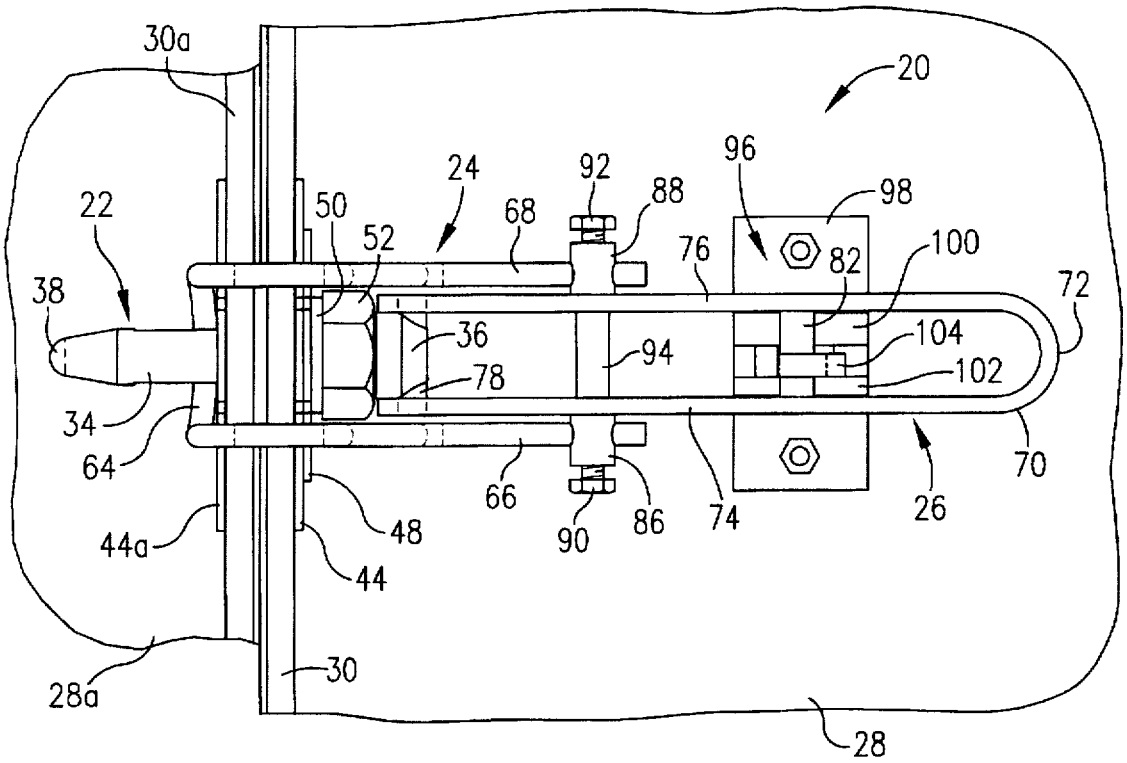
FIG. 5 is an elevational view similar to that of FIG. 1, but showing the interconnecting assembly in its extended, locking position.
Figure 6:
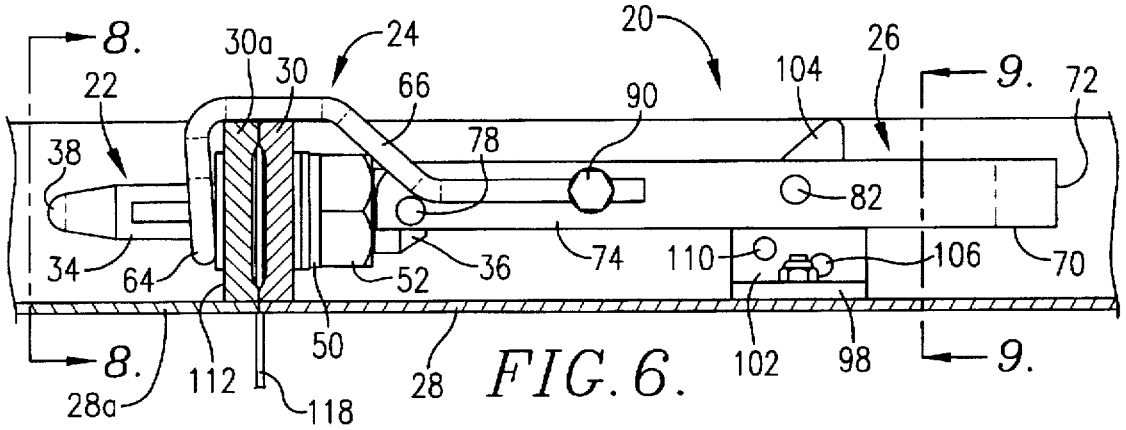
FIG. 6 is a sectional view similar to that of FIG. 2, but depicting the interconnecting assembly in its extended, locking position.
Figure 7:
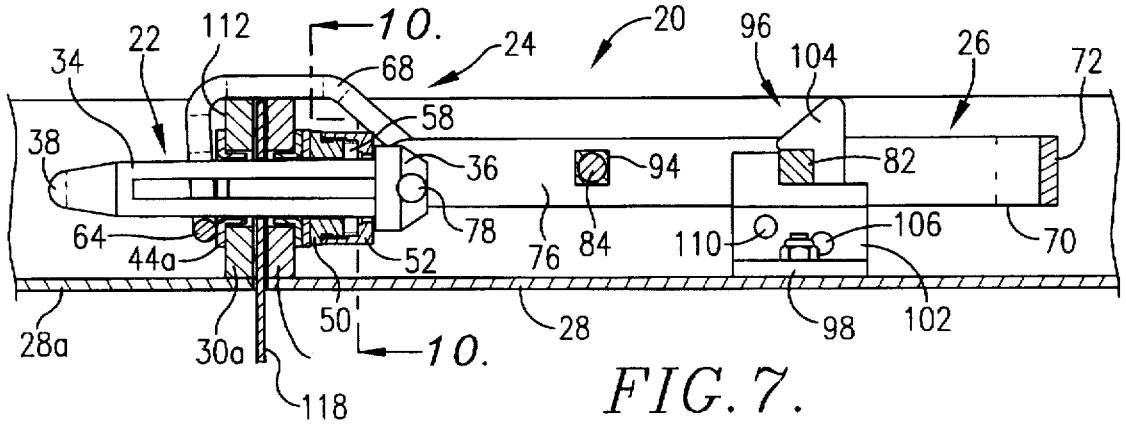
FIG. 7 is a sectional view similar to that of FIG. 3, with the interconnecting assembly in its extended, locking position.

In the final locked position depicted in FIGS. 5–7, the assembly 20 securely holds the form panels 28, 28*a* in abutting, end-to-end relationship. The arm 24 exerts considerable compressive force by virtue of the engagement of bight segment 64 against plate 44*a* (and thus the inner face 112 of wall 30*a*). At the same time, the pin 22 in its extended, locking position prevents significant relative movement between the panels 28, 28*a*. It will further be noted that the shank 34 of pin 22 extends through bight segment 64, i.e., the shank 34 is between the parallel portions of the bight segment (see FIG. 8).

When it is desired to disconnect the panels 28, 28*a*, it is only necessary to manually pivot latch 104 rightwardly as viewed in FIGS. 5–7, followed by counterclockwise pivoting of handle 70 so as to move segment 64 of arm 24 away from face 112 of wall 30*a*. The arm 24 is then pivoted up to assume its nested configuration adjacent handle 70, and the latter is pulled rightwardly as viewed in FIGS. 5–7 in order to withdraw the pin 22 until the latter reassumes its retracted position depicted in FIGS. 1–3. In such position, the handle 70 is pivoted in a counterclockwise direction allowing latch 104 to pivot and come into locking engagement with block segment 94. Thus, the assembly 20 reassumes its retracted and ready position illustrated in FIGS. 1–3.

It will thus be seen that the present invention provides an interlock assembly for form panels which completely eliminates loose parts and materially decreases setup and knockdown times. Moreover, the elimination of loose parts provides a safer and more secure interconnection than many prior art systems, e.g., there is no possibility of inadvertent detachment of wedges or the like which can lead to failure of the form.

We claim:

1. An assembly for releasably interconnecting a pair of panels cooperatively presenting first and second adjacent walls having respective generally aligned apertures there through, said assembly comprising:

an elongated pin presenting a longitudinal axis a forward end and a rearward end and axially shiftable between a retracted position where the forward end of the pin is proximal to the aperture through said first wall, and an extended connecting position wherein the pin is oriented to extend through the apertures of both said first and second walls;

an elongated connection arm having a forward end and a rearward end and of length sufficient to bridge said first and second walls, said arm being selectively movable between a retracted, non-bridging position, and an extended position where the arm bridges said first and second walls and said forward end engages one of the first and second walls; and operating mechanism operatively coupled with said pin and arm for selective shifting of said pin between said retracted and extended positions thereof, and for causing said arm to draw said first and second walls together in compression when the arm is in said extended position thereof, said operating mechanism including structure for pivoting of said arm about an axis transverse to said pin longitudinal axis.

2. The assembly of claim 1, including latch means for releasably maintaining said pin and arm in said extended and connecting positions thereof.

3. The assembly of claim 1, said operating mechanism comprising:

a handle pivotally coupled to the rearward end of said pin; and means pivotally connecting the rearward end of said arm to said handle, said handle being movable in a direction for movement of said arm in a direction to draw said first and second walls together.

4. The assembly of claim 1, the forward end of said arm presenting a bight segment engageable with said one wall, said pin extending through said bight segment when the pin is in said extended connecting position thereof.

5. The assembly of claim 4, there being a pair of spaced arm sections extending from said bight segment, the ends of said arm sections remote from said bight section being coupled with said operating mechanism.

6. The assembly of claim 1, including means captively retaining said pin on one of said panels, said operating mechanism including a handle pivotally connected to the rearward end of said pin, said connection arm being pivotally connected to said handle.

7. An assembly for releasably interconnecting a pair of panels cooperatively presenting first and second adjacent walls having respective generally aligned apertures there through, said assembly comprising:

an elongated pin presenting a forward end and a rearward end and axially shiftable between a retracted position where the forward end of the pin is proximal to the aperture through said first wall, and an extended connecting position wherein the pin is oriented to extend through the apertures of both said first and second walls;

an elongated connection arm having a forward end and a rearward end and of length sufficient to bridge said first and second walls, said arm being selectively movable between a retracted, non-bridging position, and an extended position where the arm bridges said first and second walls and said forward end engages one of the first and second walls, the forward end of said arm presenting a bight segment engageable with said one wall, said pin extending through said bight segment when the pin is in said extended connecting position thereof, and operating mechanism operatively coupled with said pin and arm for selective shifting of said pin between said retracted and extended positions thereof, and for causing said arm to draw said first and second walls together when the arm is in said extended position thereof.

8. The assembly of claim 7, there being a pair of spaced arm sections extending from said bight segment, the ends of said arm sections remote from said bight section being coupled with said operating mechanism.

9. An assembly for releasably interconnecting a pair of panels cooperatively presenting first and second adjacent walls having respective generally aligned apertures there through, said assembly comprising:

an elongated pin presenting a forward end and a rearward end and axially shiftable between a retracted position where the forward end of the pin is proximal to the aperture through said first wall, and an extended connecting position wherein the pin is oriented to extend through the apertures of both said first and second walls;

an elongated connection arm having a forward end and a rearward end and of length sufficient to bridge said first and second walls, said arm being selectively movable between a retracted, non-bridging position, and an extended position where the arm bridges said first and second walls and said forward end engages one of the first and second walls;

operating mechanism operatively coupled with said pin and arm for selective shifting of said pin between said retracted and extended positions thereof, and for causing said arm to draw said first and second walls together when the arm is in said extended position thereof, said operating mechanism including a handle pivotally connected to the rearward end of said pin, said connection arm being pivotally connected to said handle; and means captively retaining said pin on one of said panels.

* * * * *